US009879498B2

(12) United States Patent
Holland, Jr.

(10) Patent No.: US 9,879,498 B2
(45) Date of Patent: Jan. 30, 2018

(54) SHEAR BLOCK DESIGN FOR BLOWOUT PREVENTER

(71) Applicant: Axon EP, Inc., Houston, TX (US)

(72) Inventor: William Rinehart Holland, Jr., Spring, TX (US)

(73) Assignee: Axon Pressure Products, Inc., Houston, TX (US)

( * ) Notice: Subject to any disclaimer, the term of this patent is extended or adjusted under 35 U.S.C. 154(b) by 360 days.

(21) Appl. No.: 14/692,370

(22) Filed: Apr. 21, 2015

(65) Prior Publication Data

US 2016/0312564 A1 Oct. 27, 2016

(51) Int. Cl.
*E21B 33/06* (2006.01)

(52) U.S. Cl.
CPC ..... *E21B 33/063* (2013.01)

(58) Field of Classification Search
CPC ..... E21B 33/063; E21B 33/062; E21B 29/08
See application file for complete search history.

(56) References Cited

U.S. PATENT DOCUMENTS 4,537,250 A * 8/1985 Troxell, Jr. ..... E21B 29/08 166/55
4,646,825 A * 3/1987 Van Winkle ..... E21B 29/08 166/55
5,360,061 A * 11/1994 Womble ..... E21B 29/08 166/55
5,515,916 A * 5/1996 Haley ..... E21B 33/063 166/55
6,173,770 B1 * 1/2001 Morrill ..... E21B 33/063 166/55
2008/0286534 A1 11/2008 Springett et al.
2012/0006529 A1 * 1/2012 Springett ..... E21B 33/063 166/55

* cited by examiner

*Primary Examiner* — Michael R Wills, III
(74) *Attorney, Agent, or Firm* — Baker Botts L.L.P.

(57) ABSTRACT

Present embodiments of the disclosure are directed to a blowout preventer having a ram unit designed to shear wellbore tubulars with a range of diameters. The ram unit may include a first shear block having a first blade profile, and a second shear block having a second blade profile. The blade profiles may each feature an angled portion for contacting the wellbore tubular. The angled portion of the first blade profile may be a different size (e.g., width dimension) than the angled portion of the second blade profile. This may enable the larger angled portion to support a smaller tubular while contact points on the smaller angled portion apply a force for shearing the tubular. With larger tubulars, an initial edge of the blade profile with the smaller angled portion may support the tubular while contact points on the larger angled portion apply a force for shearing the tubular.

20 Claims, 2 Drawing Sheets

SHEAR BLOCK DESIGN FOR BLOWOUT PREVENTER

TECHNICAL FIELD

Embodiments of the present disclosure relate generally to blowout preventers, and more specifically, to improved blade profiles for shear blocks in a blowout preventer ram unit.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light and not as admissions of prior art.

Blowout preventers are used extensively throughout the oil and gas industry. Typical blowout preventers include a main body to which are attached various types of ram units. The two categories of blowout preventers that are most prevalent are ram blowout preventers and annular blowout preventers. Blowout preventer stacks frequently utilize both types, typically with at least one annular blowout preventer stacked above several ram blowout preventers. The ram units in ram blowout preventers allow for both the shearing of the wellbore tubular and the sealing of the blowout preventer. Typically, a blowout preventer stack may be secured to a wellhead and may provide a means for sealing the well in the event of a system failure.

Existing ram units often include shear blocks designed to be forced together to shear the wellbore tubular and seal the blowout preventer. The shear blocks generally feature opposing blade profiles used to cut the wellbore tubular. In some ram units, the opposing blade profiles feature a straight across cutting edge and/or a V-shaped cutting edge for shearing the wellbore tubular. In other existing ram units, the opposing blade profiles feature cutting points formed at acute angles extending toward the wellbore tubular to puncture and crush the wellbore tubular. Unfortunately, such blade profiles can lead to inefficient shearing of the wellbore tubular if the wellbore tubular (e.g., particularly a wellbore tubular with small outer diameter) slips between the opposing cutting points.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

One or more specific embodiments of the present disclosure will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Generally, embodiments of the disclosure are directed to a blowout preventer having a ram unit designed to shear and seal wellbore tubulars with a wide range of outer diameters. The ram unit may include a first shear block having a first blade profile, and a second shear block having a second blade profile. The first and second blade profiles may each feature an angled portion for contacting the wellbore tubular. The angled portion of the first blade profile may be a different size (e.g., width dimension) than the angled portion of the second blade profile. This may enable the larger angled portion to support a smaller wellbore tubular while contact points on the smaller angled portion apply a force for shearing the wellbore tubular. When the wellbore tubular is larger, an initial edge portion of the blade profile with the smaller angled portion may be used to support the wellbore tubular while contact points on the larger angled portion apply a force for shearing the wellbore tubular.

The contact points formed where the angled portions meet the initial edge portions of the respective shear blocks may provide more than one crush point on a given side of the wellbore tubular. An opposite side of the tubular may be supported against the opposing shear block, thus preventing the wellbore tubular from slipping within the ram unit. Such slipping can occur in existing shear block designs where the blade profiles feature sharp angles extending toward the wellbore tubular. These sharp angles can provide a failure point for shearing the wellbore tubular, but sometimes the wellbore tubular can slide to one side or the other of the sharp angled profile, leading to inefficient operation of the blowout preventer. Presently disclosed embodiments feature no such sharp angles extending toward the wellbore tubular, but rely instead on soft radiuses of the angled portions and initial edge portions of the shear blocks to support the wellbore tubular and provide multiple contact points for collapsing the wellbore tubular inward on itself to efficiently shear the wellbore tubular.

Figure 1:
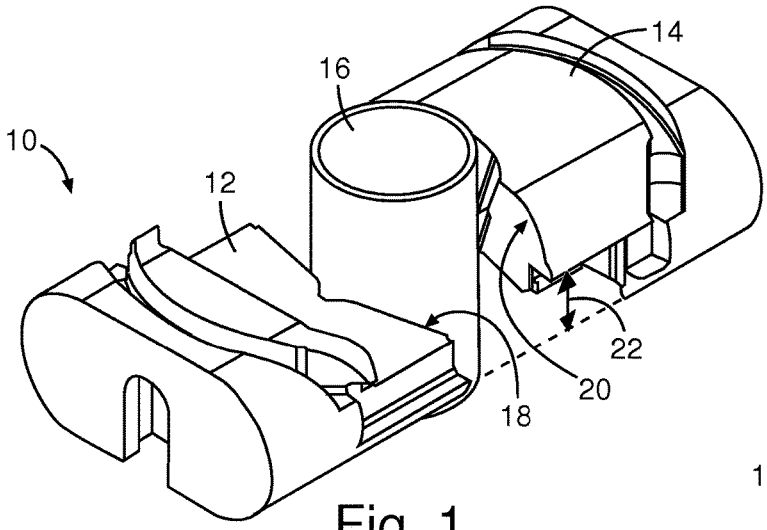
FIG. 1 is a perspective view of opposing shear blocks of a blowout preventer ram unit disposed around a wellbore tubular, in accordance with embodiments of the present disclosure.

Turning now to the drawings, FIG. 1 illustrates certain components of a ram unit 10 that can be used in a blowout preventer. The ram unit 10 may include two opposing shear blocks 12 and 14 designed to be actuated together via one or more actuation components of the ram unit 10 to shear a wellbore tubular 16 and seal the blowout preventer. The wellbore tubular 16 is generally positioned between the shear blocks 12 and 14 of the blowout preventer. The wellbore tubular 16 may be a joint or string of drill pipe, casing, production tubing, or some other tubular component extending into a wellbore formed through a subterranean formation. During normal drilling, completion, and production operations at a well site, the shear blocks 12 and 14 may be held in open positions separated from one another to allow the wellbore tubular 16 to pass through the blowout preventer. In the event of a system failure downhole, the blowout preventer may actuate the shear blocks 12 and 14 toward each other and into shearing engagement with the wellbore tubular 16. This may cause the ram unit 10 to close and seal the wellbore tubular 16.

In presently disclosed embodiments, each of the shear blocks 12 and 14 may include a specific blade profile designed to shear the wellbore tubular 16 in an efficient manner. The shear block 12 may feature the blade profile 18, while the opposing shear block 14 may feature the blade profile 20. As illustrated, the blade profiles 18 and 20 for the shear blocks 12 and 14, respectively, may be different from one another. Specific embodiments of the opposing blade profiles 18 and 20 are discussed in detail below.

In some embodiments, the shear blocks 12 and 14 may be vertically offset from one another, as shown in FIG. 1. That is, a bottom surface of one shear block 12 may be positioned vertically lower than a bottom surface of the other shear block 14. The shear blocks 12 and 14 may be offset by a certain distance 22 such that an upper surface of the lower shear block 12 may be positioned at or just below the bottom surface of the upper shear block 14. This allows the shear blocks 12 and 14 to move past each other at the point where a leading edge of each of the shear blocks 12 and 14 contacts and shears the wellbore tubular 16.

Figure 2:
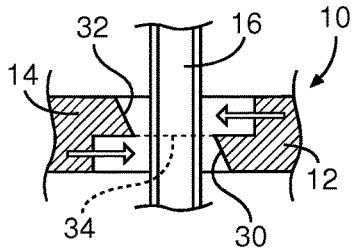
FIG. 2 is a cross sectional view of the opposing shear blocks of FIG. 1 being used to shear a wellbore tubular, in accordance with embodiments of the present disclosure.

As shown in FIG. 2, the shear blocks 12 and 14 may each include a slanted shearing surface 30 and 32, respectively, that follows the shape of the respective blade profiles 18 and 20. These slanted shearing surfaces 30 and 32 may be slanted so that the leading edges of both shear blocks 12 and 14 contact the wellbore tubular 16 at approximately the same vertical position. This vertical position is indicated by a dashed line 34 in FIG. 2. This may enable a clean and effective shearing of the wellbore tubular 16 using less force than would be needed if the shear blocks had vertically oriented shearing surfaces for contacting the wellbore.

Figure 3:
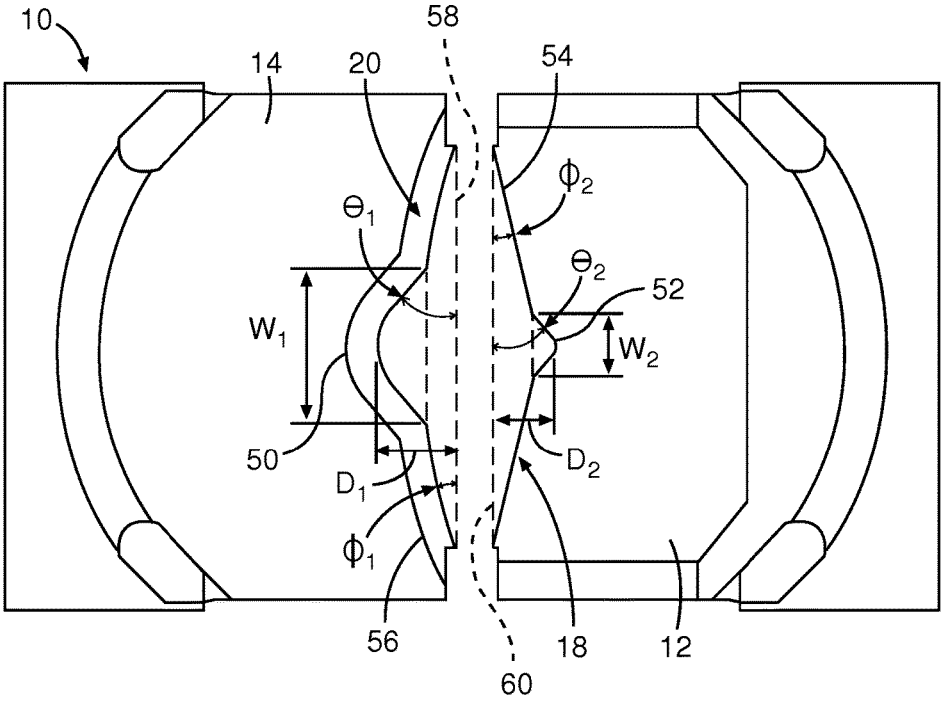
FIG. 3 is an above view of the opposing shear blocks of FIG. 1, in accordance with embodiments of the present disclosure.

FIG. 3 illustrates an embodiment of the shear blocks 12 and 14 specifically designed to accommodate wellbore tubulars having a variety of outer diameters. For example, the shear blocks 12 and 14 may be sized and designed to shear wellbore tubulars having outer diameters ranging from approximately 2 inches to approximately 7 inches. As mentioned above, the shear blocks 12 and 14 have differently shaped blade profiles 18 and 20 that work together to efficiently shear the wellbore tubular disposed therebetween.

The illustrated shear block 14, for example, may include a blade profile 20 having an angled section 50 with a width dimension $W_1$, and the shear block 12 may include a blade profile 18 having an angled section 52 with a width dimension $W_2$. As illustrated, the first width dimension $W_1$ of the blade profile 20 is larger than the second width dimension $W_2$ of the blade profile 18. These different sized angled sections 50 and 52 may allow the ram unit 10 to easily and efficiently cut through a range of different sized wellbore tubulars. The different sized angled section 50 and 52 may be used in combination to shear the wellbore tubular using less pressure than would be necessary to shear the tubular with shear blocks having identical blade profiles.

As illustrated, the blade profile 18 may include an initial edge section 54 extending from both sides of the angled section 52 of the blade profile 18. The angled section 52 may be generally angled such that it extends from the initial edge section 54 into the shear block 12 in a direction away from the oppositely facing shear block 14. Similarly, the blade profile 20 of the shear block 14 may include an initial edge section 56 extending from both sides of the angled section 50 of the blade profile 20. The angled section 50 may be generally angled such that it extends from the initial edge section 56 into the shear block 14 in a direction away from the oppositely facing shear block 12.

In the illustrated embodiment, the angled sections 50 and 52 of each blade profile are generally rounded V-shaped sections (i.e., V-shaped sections each having a soft radius). The soft radius of each profile may allow wellbore tubulars of different sizes to work their way into the opposing angled sections 50 and 52 prior to the blade profiles 18 and 20 shearing the wellbore tubular. In other embodiments, the angled sections 50 and 52 may each feature a rounded profile with a diameter of approximately the corresponding width dimension (i.e., $W_1$ and $W_2$). In still other embodiments, the angled sections 50 and 52 may be V-shaped sections with straight edges.

It should be noted that the blade profiles 18 and 20 do not include any acute angled portions extending outward in a direction of the opposing shear block. Such acute angled portions extending toward the wellbore tubular could potentially cause the wellbore tubular to slip to one side or the other of the acute angled portion. Such slippage is not a concern for the disclosed embodiments, since the blade profiles 18 and 20 are designed to seat the wellbore tubular within one or both of the inwardly-extending angled sections 50 and 52.

In the illustrated embodiment, the initial edge section 54 of the blade profile 18 may be angled slightly inward toward the angled section 52 of the blade profile 18 and in a direction away from the opposing shear block 14. Similarly, the initial edge section 56 of the blade profile 20 may be angled slightly inward toward the angled section 50 of the blade profile 20 and in a direction away from the opposing shear block 12. In other embodiments, the initial edge sections 54 and 56 of the respective blade profiles 18 and 20 may be inwardly rounded. In still other embodiments, the initial edge sections 54 and 56 may cut straight across the width of the respective blade profiles 18 and 20 until the points where the initial edge sections 54 and 56 meet the angled sections 52 and 50.

As mentioned above, the width dimension $W_1$ of the angled section 50 of the blade profile 20 may be larger than the width dimension $W_2$ of the angled section 52 of the opposing blade profile 18. In some embodiments, the width dimension $W_1$ of the angled section 50 may be within a range of approximately 3 to 6 inches, or approximately equal to 4.5 inches. The width dimension $W_2$ of the angled section 52 may be within a range of approximately 0.5 to 2.5 inches, or approximately equal to 1.8 inches. The illustrated width dimensions are taken as a distance between contact points where the angled sections 50 and 52 meet their respective initial edge sections 56 and 54.

Similarly, the angled section 50 may extend into the shear block 14 by a depth dimension $D_1$ that is larger than a depth dimension $D_2$ of the angled section 52 extending into the opposing shear block 12. In some embodiments, the depth dimension $D_1$ of the angled section 50 may be within a range of approximately 1 to 3 inches, or approximately equal to 2.2 inches. The depth dimension $D_2$ of the angled section 52 may be within a range of approximately 0.5 to 2.5 inches, or approximately equal to 1.8 inches. The illustrated depth dimensions $D_1$ and $D_2$ are taken as a distance from a straight line (58, 60) across the width of each shear block at its furthest point in a direction of the opposite shear block and a most inwardly extending point of the angled section. In the following discussion, these lines may be referred to by reference numerals 58 (for the blade profile 20) and 60 (for the blade profile 18).

In some embodiments, the initial edge sections 56 and 54 may be angled relative to the respective lines 58 and 60 extending straight across the respective shear blocks 14 and 12. As illustrated, the angle $\varphi_1$ that the initial edge section 56 makes with the line 58 may be equal to the angle $\varphi_2$ that the initial edge section 54 makes with the line 60. For example, in the illustrated embodiment, both angles $\varphi_1$ and $\varphi_2$ may be approximately equal to 12.5°. In other embodiments, these angles $\varphi_1$ and $\varphi_2$ may be different from one another.

In the disclosed embodiments, the angled sections 50 and 52 are generally angled relative to the respective lines 58 and 60. As illustrated, angle $\theta_1$ that the angled section 50 makes relative to the line 58 may be smaller than the angle $\theta_2$ that the angled section 52 makes with line 60. For example, in the illustrated embodiment, the angle $\theta_1$ may be approximately equal to 40° and the angle $\theta_2$ may be approximately equal to 45°.

The dimensions described above for the blade profiles 18 and 20 illustrated in FIG. 3 represent only one embodiment of the disclosed design. It should be noted that other embodiments of the blade profiles 18 and 20 may conform to different dimensions (e.g., widths, depths, angles) and ratios of these respective dimensions than those shown in FIG. 3. Indeed, the disclosed embodiments are directed in general to blade profiles 18 and 20 having different sized angles sections 52 and 50 formed therein to accommodate a range of sizes of wellbore tubulars.

Having now discussed the general shape and dimensions of the blade profiles 18 and 20 used in the disclosed ram unit 10, two detailed examples of the ram unit 10 being used to shear different sized wellbore tubulars will be provided.

Figure 4:
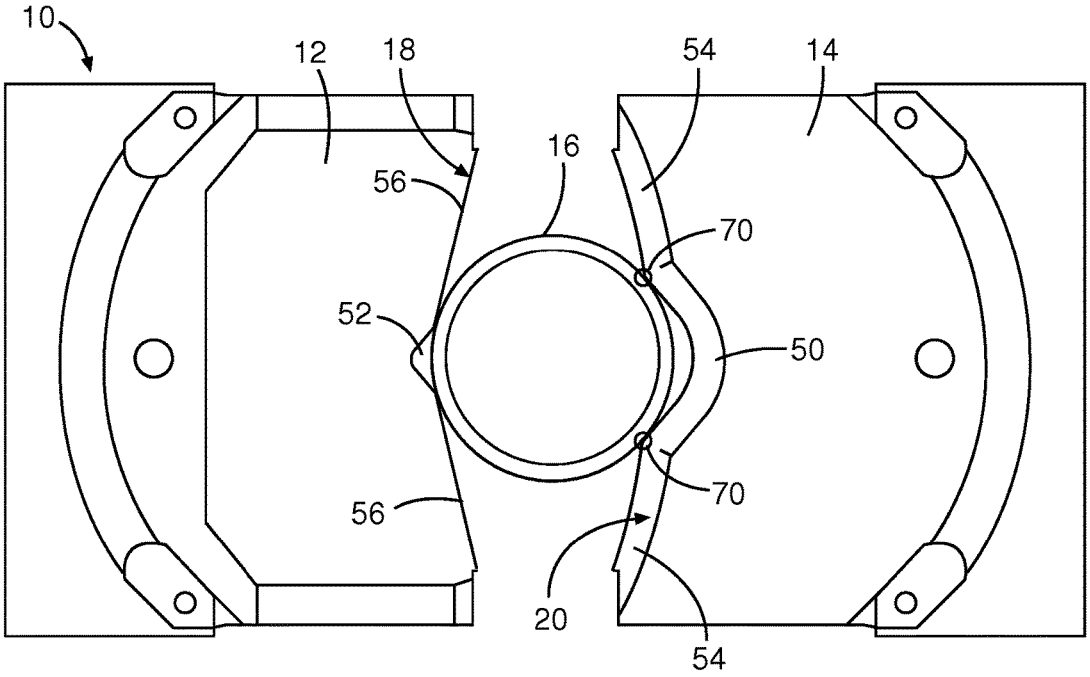
FIG. 4 is an above view of the opposing shear blocks of FIG. 1 being used to shear a large wellbore tubular, in accordance with embodiments of the present disclosure.

FIG. 4 illustrates the ram unit 10 being used to shear a relatively large wellbore tubular 16. As illustrated, the relatively large wellbore tubular 16 may have an outer diameter that is larger than the width $W_1$ of the larger angled section 50. Thus, the illustrated tubular 16 cannot fit into the smaller angled section 52 of the shear block 12 or the larger angled section 50 of the shear block 14. Instead, the tubular 16 may be supported against the slightly angled initial edge section 56 of the shear block 12 while the opposing shear block 14 applies a force to shear the wellbore tubular 16. As illustrated, the points of the blade profile 20 where the angled section 50 intersects the initial edge section 54 may act as contact points 70 for applying a contact force from the shear block 14 to the wellbore tubular 16 resting against the opposing shear block 12. Thus, the larger wellbore tubular 16 may be supported by the blade profile 18 having the smaller angled section 52 and cut with the bladed profile 20 having the larger angled section 50.

Figure 5:
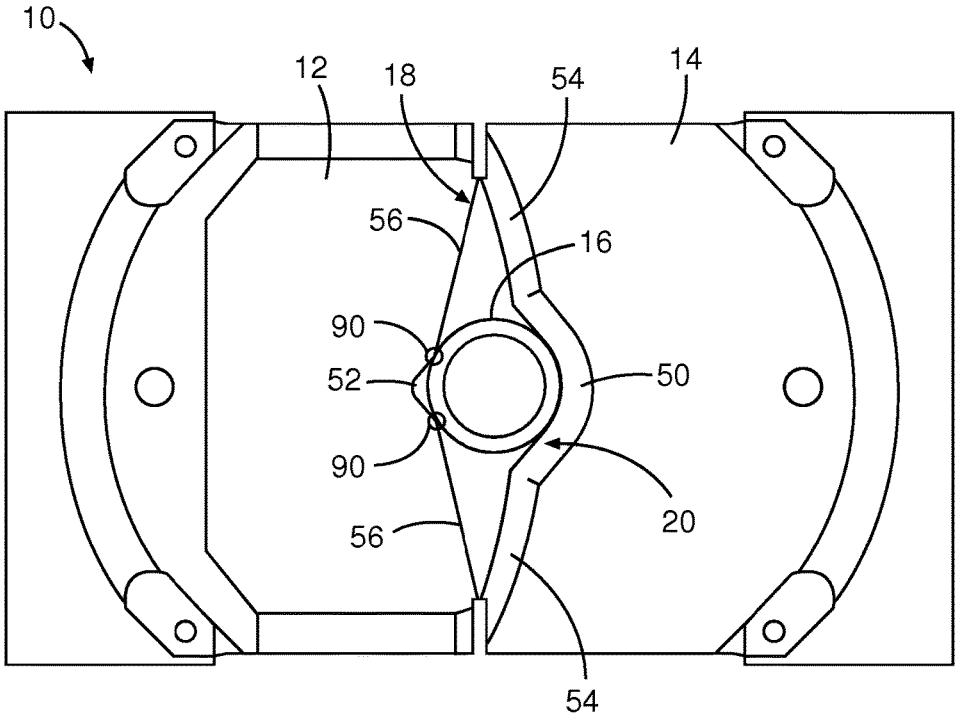
FIG. 5 is an above view of the opposing shear blocks of FIG. 1 being used to shear a small wellbore tubular, in accordance with embodiments of the present disclosure.

FIG. 5 illustrates the ram unit 10 being used to shear a relatively small wellbore tubular 16. As illustrated, the relatively small wellbore tubular 16 may have an outer diameter that is smaller than the width $W_1$ of the larger angled section 50. Thus, the illustrated tubular 16 can fit into the larger angled section 50 of the shear block 14. The tubular 16 may therefore be supported within the curved/angled profile of the angled section 50 of the shear block 14 while the opposing shear block 12 applies a force to shear the wellbore tubular 16. As illustrated, the points of the blade profile 18 where the angled section 52 intersects the initial edge section 56 may act as contact points 90 for applying a contact force from the shear block 12 to the wellbore tubular 16 resting against the opposing shear block 14. Thus, the smaller wellbore tubular 16 may be supported by the blade profile 20 having the larger angled section 50 and cut with the blade profile 18 having the smaller angled section 52.

As illustrated and discussed above with reference to FIGS. 4 and 5, the disclosed shear blocks 12 and 14 may be designed to shear wellbore tubulars 16 of different sizes by applying a shearing force at a pair of contact points (e.g., 70, 90). Thus, the disclosed design enables shearing pressure to be applied to the wellbore tubular 16 at two contact points on one side of the tubular, instead of just a single contact point on each side of the tubular. This may increase the stability of the wellbore tubular 16 within the ram unit 10 as the shear blocks 12 and 14 are actuated together to shear the wellbore tubular 16 and seal the blowout preventer.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

What is claimed is:

1. A blowout preventer, comprising:

a ram unit comprising a first shear block and a second shear block, wherein the ram unit is configured to force the first shear block and the second shear block together to shear and seal a wellbore tubular disposed within the ram unit;

wherein the first shear block comprises a first blade profile having an angled section with a first width for contacting a wellbore tubular, and wherein the second shear block comprises a second blade profile having an angled section with a second width for contacting the wellbore tubular, wherein the first width is larger than the second width;

wherein the first blade profile further comprises an initial edge section extending from both sides of the angled section, wherein the angled section of the first blade profile extends from the initial edge section into the first shear block in a direction away from the second shear block;

wherein the first blade profile further comprises contact points where the angled section intersects the initial edge section of the first blade profile;

wherein the second blade profile further comprises an initial edge section extending from both sides of the angled section, wherein the angled section of the second blade profile extends from the initial edge section into the second shear block in a direction away from the first shear block;

wherein the second blade profile further comprises contact points where the angled section intersects the initial edge section of the second blade profile;

wherein the initial edge section of the second blade profile is configured to support the wellbore tubular when the wellbore tubular comprises an outer diameter larger than the first width of the first blade profile.

2. The blowout preventer of claim 1, wherein the initial edge section of one or both of the first and second blade profiles comprises a straight edge.

3. The blowout preventer of claim 1, wherein the initial edge section of one or both of the first and second blade profiles comprises a rounded edge.

4. The blowout preventer of claim 1, wherein the contact points of the first blade profile are configured to apply a contact force for shearing the wellbore tubular when the wellbore tubular is supported in the second blade profile.

5. The blowout preventer of claim 1, wherein the angled section of the first blade profile is configured to support the wellbore tubular when the wellbore tubular comprises an outer diameter smaller than the first width of the first blade profile.

6. The blowout preventer of claim 5, wherein the contact points of the second blade profile are configured to apply a contact force for shearing the wellbore tubular when the wellbore tubular is supported in the first blade profile.

7. The blowout preventer of claim 1, wherein the first shear block comprises a slanted shearing surface that follows the shape of the first blade profile, and wherein the second shear block comprises a slanted shearing surface that follows the shape of the second blade profile.

8. The blowout preventer of claim 1, wherein the first width is within a range of approximately 3 to 6 inches.

9. The blowout preventer of claim 1, wherein the second width is within a range of approximately 0.5 to 2.5 inches.

10. The blowout preventer of claim 1, wherein the angled sections of the first and second blade profiles comprise respective V-shaped sections.

11. The blowout preventer of claim 1, wherein the angled sections of the first and second blade profiles comprise respective rounded sections, and wherein the first width and the second width comprise diameters of the rounded sections of the first and second shear blocks, respectively.

12. The blowout preventer of claim 1, wherein the first shear block is offset from the second shear block in a vertical direction within the ram unit.

13. A method, comprising:

actuating a ram unit of a blowout preventer to move a first shear block of the ram unit and a second shear block of the ram unit toward each other, wherein the first shear block comprises a first blade profile having an angled section with a first width and the second shear block comprises a second blade profile having an angled section with a second width that is smaller than the first width; wherein the first blade profile further comprises an initial edge section extending from both sides of the angled section, wherein the angled section of the first blade profile extends from the initial edge section into the first shear block in a direction away from the second shear block; and the second blade profile further comprises an initial edge section extending from both sides of the angled section, wherein the angled section of the second blade profile extends from the initial edge section into the second shear block in a direction away from the first shear block; and shearing a wellbore tubular disposed between the first and second shear blocks via the first and second blade profiles, wherein shearing the wellbore tubular comprises:

supporting the wellbore tubular against the angled section of the first blade profile; and applying a contact force to the wellbore tubular via a pair of contact points of the second blade profile where the angled section intersects the initial edge section of the second blade profile.

14. The method of claim 13, wherein shearing the wellbore tubular comprises:

supporting the wellbore tubular against the initial edge section of the second blade profile; and applying a contact force to the wellbore tubular via a pair of contact points of the first blade profile where the angled section intersects the initial edge section of the first blade profile.

15. The method of claim 13, wherein the first width is within a range of approximately 3 to 6 inches, and wherein the second width is within a range of approximately 0.5 to 2.5 inches.

16. A blowout preventer, comprising:

a ram unit comprising a first shear block and a second shear block, wherein the ram unit is configured to force the first shear block and the second shear block together to shear and seal a wellbore tubular disposed within the ram unit;

wherein the first shear block comprises a first blade profile having an angled section with a first width for contacting a wellbore tubular, and wherein the second shear block comprises a second blade profile having an angled section with a second width for contacting the wellbore tubular, wherein the first width is larger than the second width;

wherein the first blade profile further comprises an initial edge section extending from both sides of the angled section, wherein the angled section of the first blade profile extends from the initial edge section into the first shear block in a direction away from the second shear block;

wherein the first blade profile further comprises contact points where the angled section intersects the initial edge section of the first blade profile;

wherein the second blade profile further comprises an initial edge section extending from both sides of the angled section, wherein the angled section of the second blade profile extends from the initial edge section into the second shear block in a direction away from the first shear block;

wherein the second blade profile further comprises contact points where the angled section intersects the initial edge section of the second blade profile;

wherein the angled section of the first blade profile is configured to support the wellbore tubular when the wellbore tubular comprises an outer diameter smaller than the first width of the first blade profile.

17. The blowout preventer of claim 16, wherein the initial edge section of one or both of the first and second blade profiles comprises a straight edge.

18. The blowout preventer of claim 16, wherein the initial edge section of one or both of the first and second blade profiles comprises a rounded edge.

19. The blowout preventer of claim 16, wherein the contact points of the second blade profile are configured to apply a contact force for shearing the wellbore tubular when the wellbore tubular is supported in the first blade profile.

20. The blowout preventer of claim 16, wherein the first shear block comprises a slanted shearing surface that follows the shape of the first blade profile, and wherein the second shear block comprises a slanted shearing surface that follows the shape of the second blade profile.

* * * * *